US006314057B1

(12) United States Patent
Solomon et al.

(10) Patent No.: US 6,314,057 B1
(45) Date of Patent: Nov. 6, 2001

(54) MICRO-MACHINED ULTRASONIC TRANSDUCER ARRAY

(76) Inventors: Rodney J Solomon, 25 Gavin Cir.; Bernard J Savord, 243 Highland Rd., both of Andover, MA (US) 01810; William J Ossmann, 28 Lothrop Rd., Acton, MA (US) 01720; Benjamin M Herrick, 94 Waite Rd., Boxborough, MA (US) 01719

( * ) Notice: Subject to any disclaimer, the term of this patent is extended or adjusted under 35 U.S.C. 154(b) by 0 days.

(21) Appl. No.: 09/521,871

(22) Filed: Mar. 8, 2000

Related U.S. Application Data

(60) Provisional application No. 60/133,331, filed on May 11, 1999.

(51) Int. Cl.[7] ..... H04R 23/00

(52) U.S. Cl. ..... 367/174

(58) Field of Search ..... 367/174, 163, 367/173, 170; 381/174, 191

(56) References Cited

U.S. PATENT DOCUMENTS

| | | | | |
|---|---|---|---|---|
| 5,619,476 | | 4/1997 | Haller et al. | 367/181 |
| 5,639,423 | * | 6/1997 | Northrup et al. . | |
| 5,870,351 | | 2/1999 | Ladabaum et al. | 367/163 |
| 5,894,452 | | 4/1999 | Ladabaum et al. | 367/163 |
| 5,982,709 | | 11/1999 | Ladabaum et al. | 367/170 |
| 6,004,832 | | 12/1999 | Haller et al. | 438/50 |

* cited by examiner

*Primary Examiner*—Daniel T. Pihulic

(57) ABSTRACT

A plurality of applications for a micro-machined ultrasonic transducer (MUT) including an improved MUT array containing optimized transmit MUT elements and optimized receive MUT elements, a MUT array in which staggered MUT elements increase the sensitivity of the array, and a MUT array for multiple plane scanning.

17 Claims, 4 Drawing Sheets

MICRO-MACHINED ULTRASONIC TRANSDUCER ARRAY

This application claims the benefit of U.S. Provisional Application No. 60/133,331, filed May. 11, 1999.

TECHNICAL FIELD

The present invention relates generally to ultrasonic transducers, and, more particularly, to a number of configurations of an improved micro-machined ultrasonic transducer.

BACKGROUND OF THE INVENTION

Ultrasonic transducers have been available for quite some time and are useful for interrogating solids, liquids and gasses. One particular use for ultrasonic transducers has been in the area of medical imaging. Ultrasonic transducers are typically formed of piezoelectric elements. The elements typically are made of material such as lead zirconate titanate (abbreviated as PZT), with a plurality of elements being arranged to form a transducer assembly. The transducer assembly is then further assembled into a housing possibly including control electronics, in the form of electronic circuit boards, the combination of which forms an ultrasonic probe. This ultrasonic probe, which may include acoustic matching layers between the surface of the piezoelectric transducer element or elements and the probe body, may then be used to send and receive ultrasonic signals through body tissue.

One limitation of piezoelectric devices is that the acoustic impedance of the piezoelectric material is approximately 30–35 MRayls (one MRayl being $1*10^6$ kg/m$^2$s), while the acoustic impedance of the human body is approximately 1.5 MRayls. Because of this large impedance mismatch acoustic matching layers are needed to match the piezoelectric impedance to the body impedance. Acoustic matching layers work using a ¼ wave resonance principle and are therefore narrow band devices, their presence thus reducing the available bandwidth of the piezoelectric transducer.

In order to achieve maximum resolution, it is desirable to operate at the highest possible frequency and the highest possible bandwidth.

In order to address the shortcomings of transducers made from piezoelectric materials, a micro-machined ultrasonic transducer (MUT), which is described in U.S. Pat. No. 5,619,476 to Haller, et al., has been developed. Micro-machined ultrasonic transducers address the shortcomings of piezoelectric transducers by, among other attributes, being fabricated using semiconductor fabrication techniques on a silicon substrate. The MUT's are formed using known semiconductor manufacturing techniques resulting in a capacitive non-linear ultrasonic transducer that comprises, in essence, a flexible membrane supported around its edges over a silicon substrate. By applying electrical contact material to the membrane, or a portion of the membrane, and to the silicon substrate and then by applying appropriate voltage signals to the contacts, the MUT may be energized such that an appropriate ultrasonic wave is produced. Similarly, the membrane of the MUT may be used to detect ultrasonic signals by capturing reflected ultrasonic energy and transforming that energy into movement of the membrane, which then generates a receive signal. When imaging the human body, the membrane of the MUT moves freely with the imaging medium, thus eliminating the need for acoustic matching layers. Therefore, transducer bandwidth is greatly improved.

A drawback associated with MUTs, however, is that because of the manner in which transducer cells are arranged on a substrate, significant portions of the surface area of the MUT element is devoted to support structure for the MUT membranes. Unfortunately, the support structure is acoustically inactive, thus degrading the overall sensitivity of the MUT element Therefore it would be desirable to have a number of applications in which a MUT may be employed and which may improve the performance of a MUT.

SUMMARY OF THE INVENTION

The invention provides a number of applications for a micro-machined ultrasonic transducer.

In architecture, the present invention may be conceptualized as a MUT array, comprising a first plurality of MUT elements in which each MUT element includes a first plurality of MUT cells, each MUT cell having a first cavity defined by a substrate and a first membrane; and a second plurality of MUT elements in which each MUT element includes a second plurality of MUT cells in communication with the first plurality of MUT cells, the second plurality of MUT cells each having a second cavity defined by the first membrane and a second membrane.

In another aspect, the invention may be conceptualized as a MUT array, comprising a first plurality of axially aligned MUT elements in which each MUT element includes a plurality of cells, each cell having a cavity defined by a substrate and a first membrane; and a second plurality of axially aligned MUT elements in which each MUT element includes a plurality of cells, each cell having a cavity defined by the first membrane and a second membrane, the second plurality of MUT elements located over the first plurality of MUT elements, wherein the first plurality of MUT elements are arranged substantially orthogonal to the second plurality of MUT elements.

The present invention may also be conceptualized as a method for making a MUT, comprising the steps of: forming a first plurality of MUT elements on a substrate, each element comprising a plurality of cells; and forming a second plurality of MUT elements over said first plurality of MUT elements, each element comprising a plurality of cells.

BRIEF DESCRIPTION OF THE DRAWINGS

The present invention, as defined in the claims, can be better understood with reference to the following drawings. The components within the drawings are not necessarily to scale relative to each other, emphasis instead being placed upon clearly illustrating the principles of the present invention.

DETAILED DESCRIPTION OF THE PREFERRED EMBODIMENT

The invention to be described hereafter is applicable to MUT's and includes a plurality of improved structures therefor.

Furthermore, for simplicity in the description to follow, only the principal elements of the MUT's will be illustrated.

Figure 1:
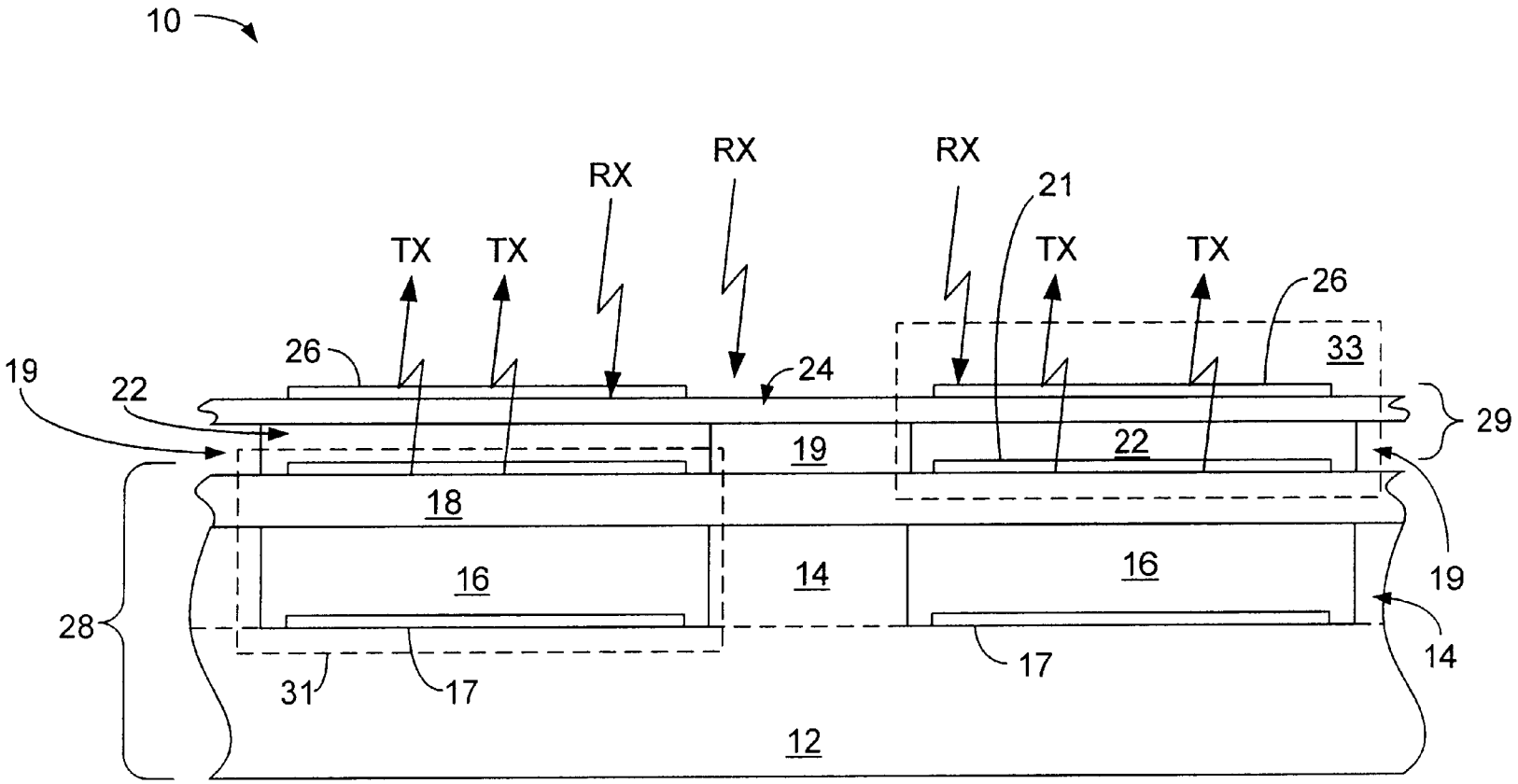
FIG. 1 is a cross-sectional schematic view illustrating a MUT array constructed in accordance with one aspect of the present invention.

Turning now to the drawings, FIG. 1 is a schematic view illustrating a MUT array 10 constructed in accordance with one aspect of the present invention. MUT array 10 includes transmit MUT element 28 and receive MUT element 29. Although not shown, a plurality of transmit MUT elements and a plurality of receive MUT elements may be included within MUT array 10. Transmit MUT element 28 includes a plurality of transmit MUT cells, an illustrative one being denoted by reference numeral 31, which are formed over substrate 12. Transmit MUT cell 31 comprises substrate 12, support element 14 and transmit membrane 18. In one embodiment of the invention, support element 14 may be composed of substrate material 12. Alternatively, support element 14 may be composed of other materials, for example but not limited to an oxide layer 10. The combination of substrate 12, support element 14 and transmit membrane 18 define transmit gap 16 in each MUT cell 31. Transmit gap 16 may be open to the environment, or may hold a vacuum depending upon the particular application of the transducer array 10. Transmit membrane 18 is a flexible member, that oscillates to generate acoustic energy due to electrical excitation during a transmit pulse and oscillates when receiving acoustic energy during receive operation.

MUT cells in general can be optimized for various parameters. For example, a MUT cell may be optimized for a transmit function or a receive function. For example, the size of the gap formed by the membrane, the support element and the substrate define the characteristics of the MUT cell. Therefore, it is possible to optimize a MUT cell to perform optimally in either transmit or receive. Transmit MUT cell 31 has transmit gap 16 optimized so that MUT transmit cell 31 is optimized for a transmit pulse.

Located above transmit MUT element 28 is receive MUT element 29. Receive MUT element 29 comprises a plurality of receive MUT cells, an illustrative one being denoted by reference numeral 33. Receive MUT cell 33 includes support element 19, which is formed over support element 14 of transmit MUT element 28. Receive gap 22 is defined by transmit membrane 18, support element 19 and receive membrane 24. In similar fashion to that described above, but with emphasis instead on receive, receive gap 22 is sized so that receive MUT cell 33 is optimized to receive an ultrasonic pulse. MUT cells 31 and 33 may be sized to be optimized for various frequencies.

In this particular embodiment, receive MUT cells 33 are located directly over transmit MUT cells 31, which also means that support elements 19 are located over support elements 14. During a transmit pulse, the MUT cells 33 of receive MUT element 29 should be electrically collapsed in order to allow acoustical energy to radiate through receive MUT cells 33 and out of the MUT array 10. Similarly, during receive operation, the MUT cells 31 of transmit MUT element 28 should be electrically stiffened, or possibly electrically collapsed, in order to allow acoustical energy to be properly detected by receive MUT element 29. Electrically stiffening and collapsing the MUT cells, as described above, is accomplished through the application of electrical potential to the MUT cells.

Each transmit MUT cell 31 includes transmit electrode 17 and common electrode 21. When transmit MUT cell 31 is excited by the application of voltage to transmit electrode 17 and common electrode 21, transmit MUT cell 31 emits an ultrasonic pulse due to the vibration of transmit membrane 18. The ultrasonic pulse is depicted by the upwardly directed arrows labeled TX. As can be seen, a transmit pulse wave travels through receive gap 22, and receive membrane 24, if collapsed, as described above, to be emitted in the direction of the arrows from the MUT array 10.

In similar fashion, receive MUT cells 33 receive acoustic energy denoted by the downwardly pointing arrows labeled RX and transform that acoustic energy through the oscillation of receive membrane 24, into an electrical signal.

As can be seen from the structure of MUT array 10, transmit MUT element 28 is optimized for transmit and MUT element 29 is optimized for receive, as evidenced by the difference in size between transmit gap 16 and receive gap 22.

As described above, the MUT cells 33 of receive MUT element 29 may be collapsed during a transmit pulse such that the transmit energy produced by transmit MUT element 28 suffers minimal attenuation. This can be done, for example, by energizing common electrode 21 and receive electrode 26 such that receive membrane 24 fills receive gap 22 during the time that transmit MUT element 28 is energized and emitting a transmit pulse. Similarly, each transmit MUT cell 31 may be electrically stiffened, or collapsed, during a receive pulse. This may be accomplished by energizing transmit electrode 17 and common electrode 21 so as to mechanically stress transmit membrane 18 if electrically stiffened, or to collapse transmit membrane into transmit gap 16 if electrically collapsed, during the time that receive MUT element 29 is receiving an acoustic energy return signal. In this manner, MUT array 10 may comprise optimized transmit MUT elements and optimized received MUT elements on a single array, thus minimizing the amount of space required to construct MUT array 10. It should be noted that there are many other ways in which to apply electrodes to the MUT elements disclosed herein, without departing from the concepts of the invention. For example, an electrode may be applied to the surface of substrate 12 opposite that of MUT elements 28 and 29.

In addition, the MUT array disclosed in FIG. 1 may be duplicated on the opposing surface of substrate 12, thus forming a mirror image of the array having optimized transmit elements and optimized receive elements. In this embodiment, the MUT array 10 may be used to simultaneously interrogate in opposite directions.

Figure 2:
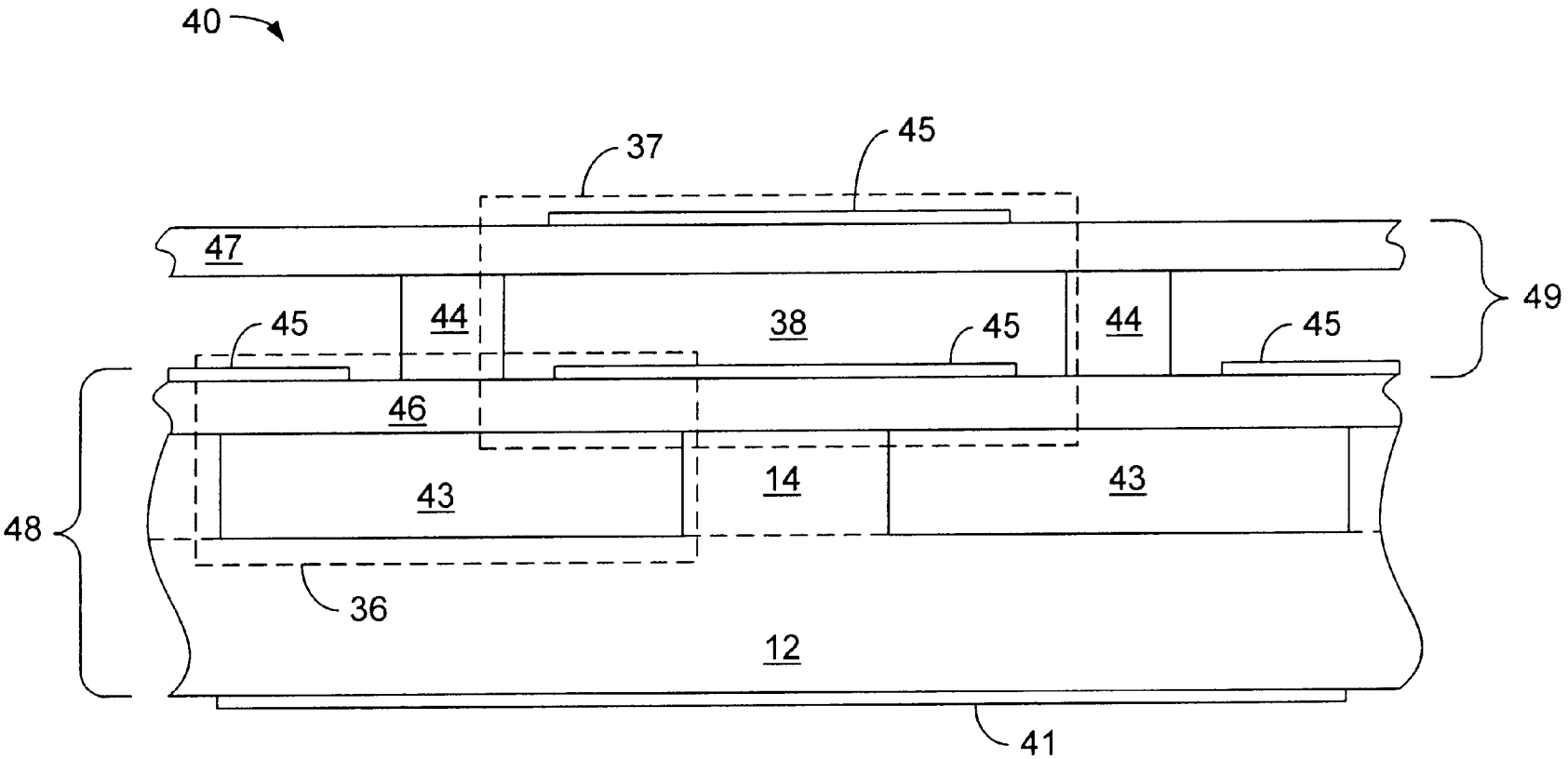
FIG. 2 is a cross-sectional schematic view illustrating a MUT array constructed in accordance with another aspect of the present invention.

FIG. 2 is a cross-sectional schematic view illustrating a MUT array 40 constructed in accordance with another aspect of the present invention.

In the MUT array of FIG. 2, the MUT cells may all be optimized for the same purpose, or may indeed be optimized for different characteristics such as that described with reference to FIG. 1. The structure of the MUT elements of FIG. 2 are similar to that described with respect to FIG. 1. Therefore, a description of the common structure will not be repeated herein.

MUT array 40 includes a plurality of MUT cells 36 formed over substrate 12 in similar fashion to that described above. MUT cells 36 define a gap 43 formed by substrate 12, support element 14 and membrane 46. Ground electrode 41 may be located on a lower surface of substrate 12 as shown herein, or alternatively, may be located within gap 43 of MUT cell 43.

Located over the MUT cells 36 of MUT element 48 are the MUT cells 37 of MUT element 49. MUT cells 37 define a gap 38 formed by membrane 46, support elements 44 and membrane 47. Signal electrodes 45 are located within gap 38 of MUT cell 37, and over membrane 47, respectively. MUT cells 37 may be used to enlarge the moving surface of MUT array 40.

Notice that MUT cell 37 is located offset, or staggered, from each MUT cell 36. This application allows support elements 44 to reside over membrane 46 of each respective MUT cell 36. However, MUT cells 38 may be located anywhere over MUT cells 36.

This staggered MUT cell geometry may eliminate dead zones in MUT element 48, which are created due to the design of MUT element 48 in which MUT cells (the acoustically active portion of MUT element 48) are separated by support elements 14 (the acoustically inactive portions of MUT element 48). The area of MUT element 48 consumed by support elements 14 degrades the sensitivity of the MUT element. In general, any region of an ultrasonic transducer that is occupied by acoustically inactive material (such as support elements 14) creates a "dead zone", which degrades the overall sensitivity of the MUT element. Therefore, it is desirable to minimize the portion of MUT element 48 that is occupied by acoustically inactive material.

As stated above, the staggered design of MUT array 40, in which MUT cells 37 are staggered over MUT cells 36 serves to increase the overall sensitivity of MUT array 40 by eliminating the dead zones between MUT cells. In a particular aspect of the invention, support elements 44 are joined to the active areas (membrane 46) of MUT elements 48, and so move with them. This arrangement tends to move membrane 47 of MUT cells 37 in unison with membrane 46 of MUT cells 36, especially if membrane 47 is sufficiently stiff and the distance between support elements 44 and, by implication, MUT cells 36 is substantially less than one wavelength. The position of support element 44 over membrane 46 may preclude or minimize the condition by which membrane 47 is collapsed during a transmit pulse. Support element 44 couples membrane 46 to membrane 47 during actuation of membrane 46. Membrane 46 should still be stiffened during receive operation.

The reduction, or elimination, of the dead zones in MUT array 40 results in a uniform motion for the active surface of the MUT array. In addition to the embodiment discussed with respect to FIG. 2, alternative embodiments are possible. For example, MUT array 40 would typically be integrated into a probe housing in which the surface opposite the substrate (i.e., the surface represented in FIG. 2 by membrane 47) interrogates the subject. Through the elimination of the dead zone, the MUT array 40 may be reversed and mounted in a housing such that the substrate side, which is typically the electrical ground, is facing the subject to be interrogated, thereby simplifying the shielding for electromagnetic interference (EMI) and improving patient safety.

The reduction or elimination of the dead zones also allows a given transmit power to require a smaller vertical motion of the membrane because the entire surface is radiating. This leads to reduction of gap size, thus increasing sensitivity of the MUT element, while reducing the bias voltage requirement and drive levels. Similarly, the linearity of the MUT element may be improved since a smaller fraction of the available range of motion is used.

Furthermore, the MUT arrays may be stacked several units deep, either right side up or upside down, thus increasing the available range of motion, and hence, transmit output power. The amount of nonlinearity may also be reduced because a given signal level would constitute a smaller fraction of the total range of motion. Because the MUT array now has distributed mass, elasticity, and electrical coupling through the thickness of the stack, lower acoustic impedance is possible.

Figure 3A:
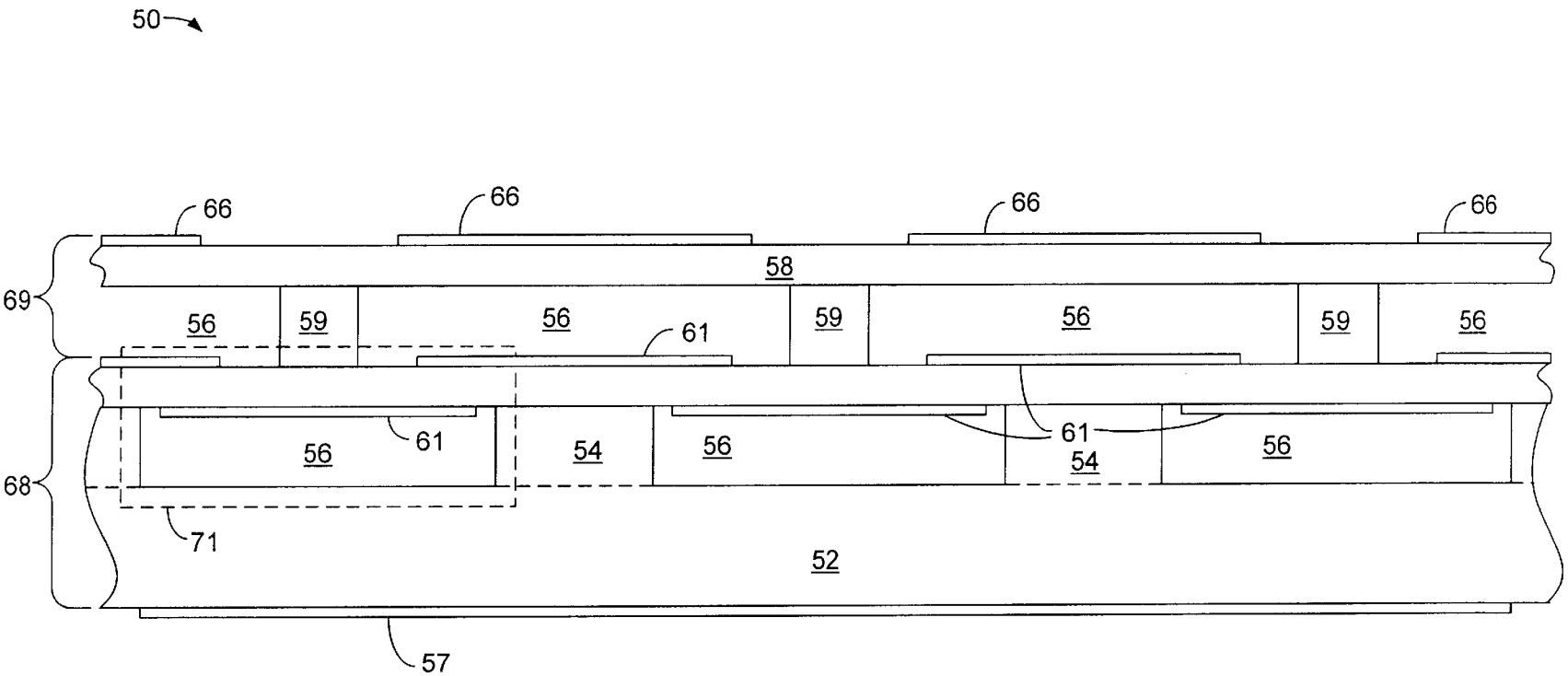
FIG. 3A is a cross-sectional schematic view illustrating a MUT array constructed in accordance with yet another aspect of the present invention.

FIG. 3A is a schematic view illustrating a MUT array 50 constructed in accordance with another aspect of the present invention. Dual plane MUT array 50 includes y plane MUT element 68 and x plane MUT element 69. Although illustrated for simplicity using a single x plane MUT element 69 and a single y plane MUT element 68, the present invention will typically be implemented using a plurality of x and y plane MUT elements. Y plane MUT element 68 further includes a plurality of MUT cells 71. Each MUT cell 71 is formed over substrate 52, substrate 52 including support elements 54. Each MUT cell 71 includes substrate 52, support element 54 and tx/rx membrane 58, which together define tx/rx gap 56. Similar to that described above, tx/rx gap 56 may either be exposed to environmental pressure or may be formed to contain a vacuum.

X plane MUT element 69 also comprises a plurality of MUT cells 71. Each MUT cell 71 in x plane MUT element 69 is formed by tx/rx membrane 58, support element 59 which define tx/Tx gap 56 similar to that described above. In this embodiment of the invention, Y plane MUT element 68 and x plane MUT element 69 may be positioned substantially orthogonal to each other, which will be Per described with reference to FIG. 3B. MUT cells 71 located on y plane MUT element 68 are excited by y electrode 57 and ground electrode 61, while MUT cells 71 located on x plane MUT element 69 are excited by x electrode 66 and ground electrode 61.

Furthermore, a plurality of x plane MUT elements and y plane MUT elements may be fabricated on the opposing surface of substrate 52 from y plane MUT element 68 and x plane MUT element 69, thus allowing array 50 to function simultaneously in opposite directions.

Figure 3B:
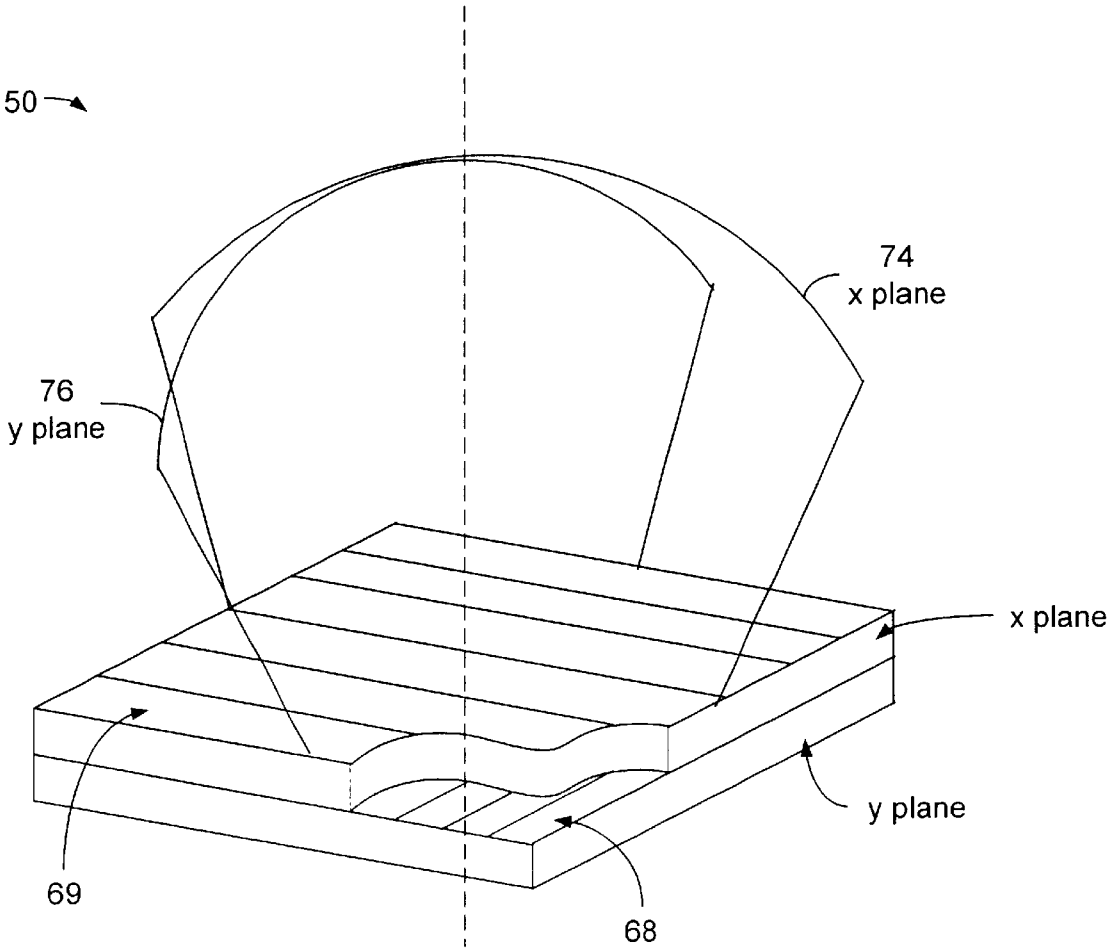
FIG. 3B is a schematic perspective view illustrating the MUT array of FIG. 3A.

FIG. 3B is a schematic perspective view illustrating the dual plane MUT array 50 of FIG. 3A. As can be seen, a plurality of y plane MUT elements 68 are arranged substantially parallel to each other, over which and orthogonal to are placed a plurality of x plane MUT elements 69, the x plane MUT elements 69 also arranged substantially parallel to each other. As can be seen, the dual plane MUT array 50 formed by x plane MUT elements 69 and y plane MUT elements 68 allow the array 50 to interrogate simultaneously in both x plane 74 and y plane 76.

Furthermore, the dual plane MUT array 50 illustrated in FIGS. 3A and 3B may be employed to form y plane MUT elements 68 and x plane MUT elements 69 into curves and compound curves. For example, the x plane MUT elements and y plane MUT elements may be formed into a spherical shape in order to interrogate a volume.

It will be appreciated by those skilled in the art that many modifications and variations may be made to the preferred embodiments of the present invention, as set forth above, without departing substantially from the principles of the present invention. For example, the present invention can be used to form micro-machined ultrasonic transducer arrays that may interrogate simultaneously in multiple directions or on compound curved surfaces. All such modifications and variations are intended to be included herein within the scope of the present invention, as defined in the claims that follow.

What is claimed is:

1. A micro-machined ultrasonic transducer (MUT) array, comprising:

a first plurality of MUT elements in which each MUT element includes a first plurality of MUT cells, each MUT cell having a first cavity defined by a substrate and a first membrane; and a second plurality of MUT elements in which each MUT element includes a second plurality of MUT cells in communication with said first plurality of MUT cells, said second plurality of M cells each having a second cavity defined by said first membrane and a second membrane.

2. The array of claim 1, wherein said second plurality of MUT cells are staggered with respect to said first plurality of MUT cells.

3. The array of claim 1, wherein said first cavity is of a size different than that of said second cavity.

4. The array of claim 1, wherein said second plurality of MUT cells are collapsed during a transmit pulse.

5. The array of claim 1, wherein said first plurality of MUT cells are stiffened during a receive pulse.

6. The array of claim 1, wherein said first plurality of MUT cells are collapsed during a receive pulse.

7. The array of claim 1, wherein said second plurality of MUT cells are located over said first plurality of MUT cells.

8. The array of claim 1, wherein said first cavity is optimized for transmit operation.

9. The array of claim 1, wherein said second cavity is optimized for receive operation.

10. The array of claim 1, further comprising:

a first additional plurality of MUT elements located on a surface of said substrate opposite that of said first plurality of MUT elements, said first additional plurality of MUT elements comprising said first plurality of MUT cells optimized for a transmit pulse; and a second additional plurality of MUT elements located on a surface of said substrate opposite that of said second plurality of MUT elements, said second additional plurality of MUT elements comprising said second plurality of MUT cells in communication with said first additional plurality of MUT cells, said second additional plurality of MUT elements having MUT cells, each MUT cell having said second cavity defined by said first membrane and a second membrane, said second cavity optimized for a receive pulse.

11. A method for making a micro-machined ultrasonic transducer (MUT), comprising the steps of:

forming a first plurality of MUT elements on a substrate, each element comprising a plurality of cells; and forming a second plurality of MUT elements over said first plurality of MUT elements, each element comprising a plurality of cells.

12. The method of claim 11, wherein said step of forming said second plurality of MUT cells further includes staggering said second plurality of MUT cells with respect to said first plurality of MUT cells.

13. The method of claim 11, wherein said step of forming a first plurality of MUT elements includes defining a plurality of cells, each cell having a first cavity and said step of forming a second plurality of MUT elements includes defining a plurality of cells, each cell having a second cavity of a different size than said first cavity.

14. The method of claim 11, further comprising the step of optimizing said first plurality of MUT cells for transmit operation.

15. The method of claim 11, further comprising the step of optimizing said second plurality of MUT cells for receive operation.

16. A micro-machined ultrasonic transducer (MUT) array, comprising:

a first plurality of axially aligned MUT elements in which each MUT element includes a plurality of cells, each cell having a cavity defined by a substrate and a first membrane; and a second plurality of axially aligned MUT elements in which each MUT element includes a plurality of cells, each cell having a cavity defined by said first membrane and a second membrane, said second plurality of MUT elements located over said first plurality of MUT elements, wherein said first plurality of MUT elements are arranged substantially orthogonal to said second plurality of MUT elements.

17. The array of claim 16, wherein said second plurality of MUT cells overlap said first plurality of MUT cells.

* * * * *